United States Patent [19]

Ming-Tang

[11] Patent Number: 4,962,799

[45] Date of Patent: Oct. 16, 1990

[54] WORKBENCH WITH ITS DEVICES

[76] Inventor: Chen Ming-Tang, 23-4, Alley 21, Lane 205, Yong Xing Rd. Dali, Taizhong, Taiwan

[21] Appl. No.: 305,976

[22] Filed: Feb. 3, 1989

[51] Int. Cl.[5] ..... B25H 1/00

[52] U.S. Cl. ..... 144/286 A; 269/296; 269/299

[58] Field of Search ..... 144/286 R, 286 A, 87; 269/296, 298, 299

[56] References Cited

U.S. PATENT DOCUMENTS 4,497,353 2/1985 Sproat, Jr. ..... 144/286 R

*Primary Examiner*—W. Donald Bray

*Attorney, Agent, or Firm*—Browdy & Neimark

[57] ABSTRACT

A workbench with its devices, which includes a work table which is formed with a plurality of o-shaped or straight bars each equally spaced apart, and adjusting clamps, which can be installed in between any two of the bar materials on the work table. If the clamps are loosened a bit, the adjusting clamps will be permitted to move in position along the bars. The use of one piece or pieces of adjusting clamps will be permitted to clamp and treat workpieces of any shape and size, wherein two slowing-going adjusting seats can be used to fix L-set plates respectively with themselves and a fixture. Each L-set plate has an upside-down U-shaped hole on its vertical portion, which contains a plurality of toothed convexities on the inner rim adapted to fit in the adjusting plate in geared shape, and is used to permit the adjustment of the angle and position of the adjusting plate in geared shape.

3 Claims, 6 Drawing Sheets

A - A SECTION

B - B SECTION

WORKBENCH WITH ITS DEVICES

FIELD OF THE INVENTION

The present invention relates to a workbench with its devices, and more particularly to a workbench having a work table which is formed with a plurality of o-rings or straight bars, each equally spaced apart. Between any two of the bar materials, there can be installed adjusting clamps, whose position is adjustable to clamp and treat workpieces of any shape and size as well as fixtures to work on such that the working process is therefore easier and more convenient.

BACKGROUND OF THE INVENTION

In general workbenches prior to this present invention usually adopt work tables composed of thick wooden plates or metal plates, which are formed with a plurality of throughgoing bores into which pegs of clamping devices may fit. However, in this way, the clamping devices fixed to the workbench will not be permitted to move or change its orientation in position as users may wish. The prior art devices can be used strictly only for clamping common workpieces, but not for those of peculiar or deviated shape and size, since it is fixed and unable to move.

Further, it has been found that such known workbenches have many pre-determined throughgoing bores made on the work table, used to meet the requirement of possible position change. Yet, this structure is not adequate, not only because it is wasteful of time and labor for assembling and disassembling the clamping devices, but also the pre-determined bores do not necessarily meet the practical need. Thus, it is hard to ensure that the working process and the stability of workpieces clamped will not therefore be affected. So, those known workbenches are still unable to be entitled as ideal workbenches.

OBJECTS OF THE INVENTION

It is therefore a primary object of the present invention to solve the aforesaid defects which occur in the conventional workbenches and to provide a workbench with its devices, which comprise: a work table, constructed by a plurality of o-rings or straight bars of the same shape but different sizes each equally spaced apart. This makes it possible for adjusting clamps to be installed in position between any two of the o-rings. And when threaded rods for firmly fixing the clamps are loosened a bit, the adjusting clamps will be able to move and change position along the o-rings, so as to be permitted to be used for clamping various workpieces which can not be clamped in position when the conventional workbenches are in use.

A further object of this present invention is to make it possible to fix a fixture on the clamping seat by which a portable tool may rightly and easily be applied by the users.

SUMMARY OF THE INVENTION

According to one aspect of the present invention, a workbench with its devices, which comprise: a work table, formed with a plurality of o-rings or straight bars of the same shape but various sizes; a pair or pairs of legs constituting a foldable stand; at least one piece of slow-going adjusting clamps, able to be fixed on the work table in position; at least one piece of quick-going adjusting clamps, able to be fixed on the work table in position; and, a fixture, able to be fixed on the clamping seat. Adjusting clamps are able to be installed in position between any two of the o-rings or straight bars of the work table and are able to move to change position and remain in proper orientation such that they are permitted to clamp workpieces of various shapes and sizes and a fixture.

SPECIFIC DESCRIPTION

Figure 1:
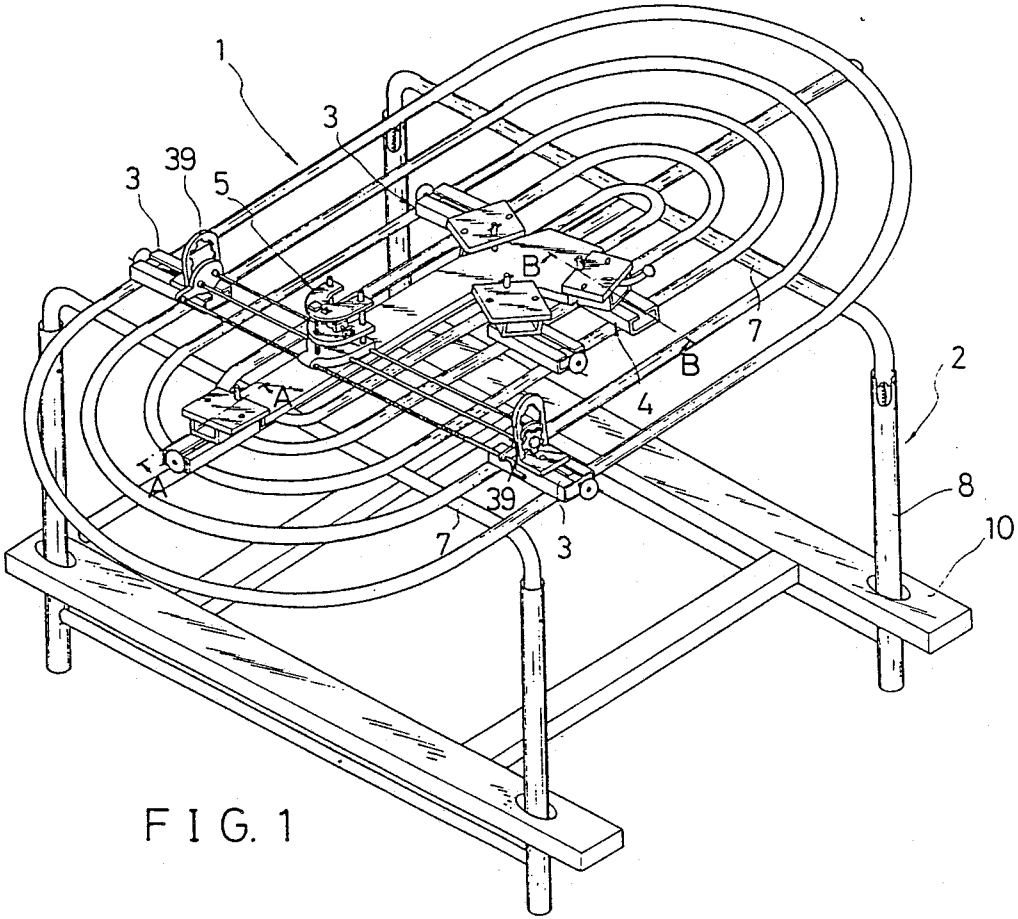
FIG. 1 is a perspective schematic view of preferred embodiment of the present invention, showing the work table with devices of a slow-going clamps, quick-going clamps and a fixture.
Figure 2:
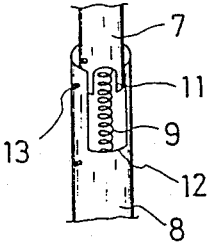
FIG. 2 is a schematic view of the legs of the workbench in FIG. 1.

As shown in FIG. 1 to 9, the present invention comprises: a work table 1 formed with a plurality of o-rings or straight bars of the same shape but various sizes, a pair or pairs of legs 2 constituting a foldable stand, one or more slow-going clamps 3 able to be fixed in position on the work table, one or more quick-going clamps 4 able to be fixed in position on the work table, and a fixture 5 able to be fixed on the clamping seat. Referring to the work table 1, it is formed with a plurality of o-rings (as shown in FIG. 1) of different sizes each equally spaced apart and supported by connecting rods 7 to ensure a horizontal work surface. The o-rings may take forms other than this annular form, such as circular or other proper multi-sided forms, only they must be equally spaced apart and ensure a horizontal work surface. Adjusting clamps 3 and 4 may be installed in position between any two of the o-rings 6, and along which they are permitted to change their orientation such that they can treat and clamp workpieces of various shapes and sizes when they are in use. The foreparts of the two ends of the connecting rods 7 are bent to 90° to continously connect with legs 2. The legs 2 comprise vertical rods 8, extension springs 9 and a positioning framework 10 (as shown in FIGS. 1 and 2), wherein on each ends of the connecting rods 7 and vertical rods 8, there contain gaps 11 and 12, which are connected by pin 13, and within which there is an extension spring 9 hinged in between. When the vertical rods are not acted by any pulling of outside force, it is able to bend at pin 13 so as to closer parallel the work table 1 by the extension of extension spring 9; and when it is stretched out to stand, positioning framework 10 will function as a support to maintain it in proper orientation.

Figure 3:
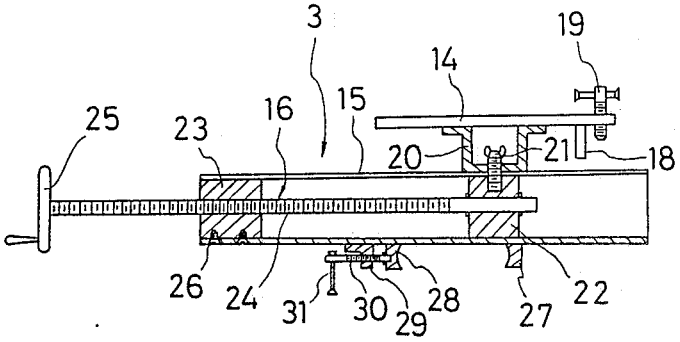
FIG. 3 is a vertical sectional view of the slow-going clamp taken along line A—A in FIG. 1.

As shown in FIGS. 1 and 3, the slow-going adjusting clamp 3 of the present invention comprises: a clamping plate 14, a throughgoing passage 15, a slow-going adjusting means 16, and a fixing means 17. The clamping plate 14 is square-shaped, and on its back side, adjacent to one end, there is an auxiliary plate 18, which is perpendicular to the clamping plate 14. The main clamping plate 14 has a chucking threaded rod 19, which chucks workpieces when it is in use. The back surface of the plate 14 is connected with a U-shaped recess 20, which is screwed by a screw 21 to a sliding block 22 of the slow-going adjusting means 16, and will change position with the movement of the sliding block 22. The slow-going adjusting means 16 is contained within the U-shaped throughgoing passage 15, comprising a fixed block 23, a sliding block 22, a threaded rod 24 and a crank 25. The fixed block 23 is screwed by a fixed screw 26 to one end of the throughgoing passage 15, having a female screw in the center, which the threaded rod 24 may go through and pass into throughgoing passage 15 to connect with the sliding block 22. The tail end of the threaded rod 24 is connected with the crank 25. The threaded rod 16 operable by the crank 25 is guided in the sliding block for adjusting the relative position of clamping plate 14 to clamp workpieces. The back side of the throughgoing passage 15 is connected with the fixing means 17, which comprises: a chucking block 27, a sliding block 28, an L-set block 29, a threaded rod 30, and a handle. The chucking block 27 is fixed under the back of the throughgoing passage 15, having an arc inner side functioned to chuck the o-rings 6 of the work table 1 firmly.

Figure 4:
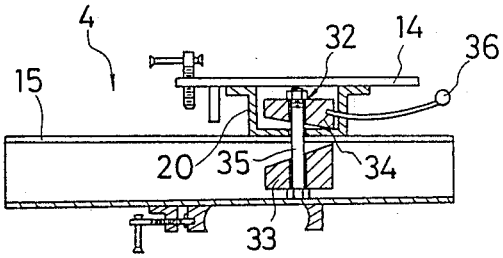
FIG. 4 is a vertical sectional view of the quick-going clamp taken along line B—B in FIG. 1.
Figure 5A:
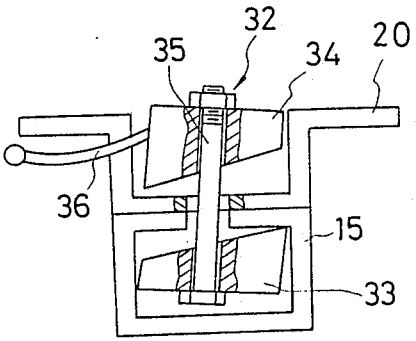
FIG. 5 is an enlarged view, showing the operation of the quick-going clamp in FIG. 4.
Figure 5B:
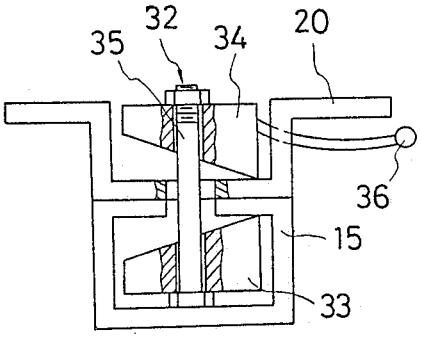
Figure 6:
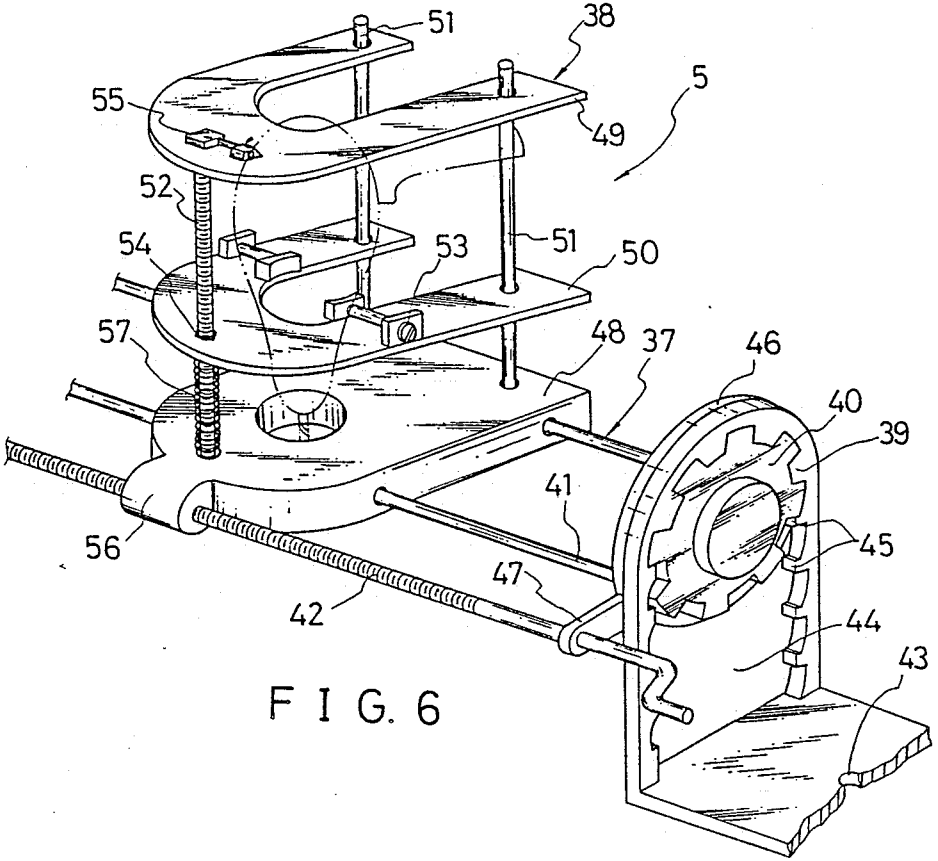
FIG. 6 is an enlarged view, showing the operation of the fixture in FIG. 1.
Figure 7:
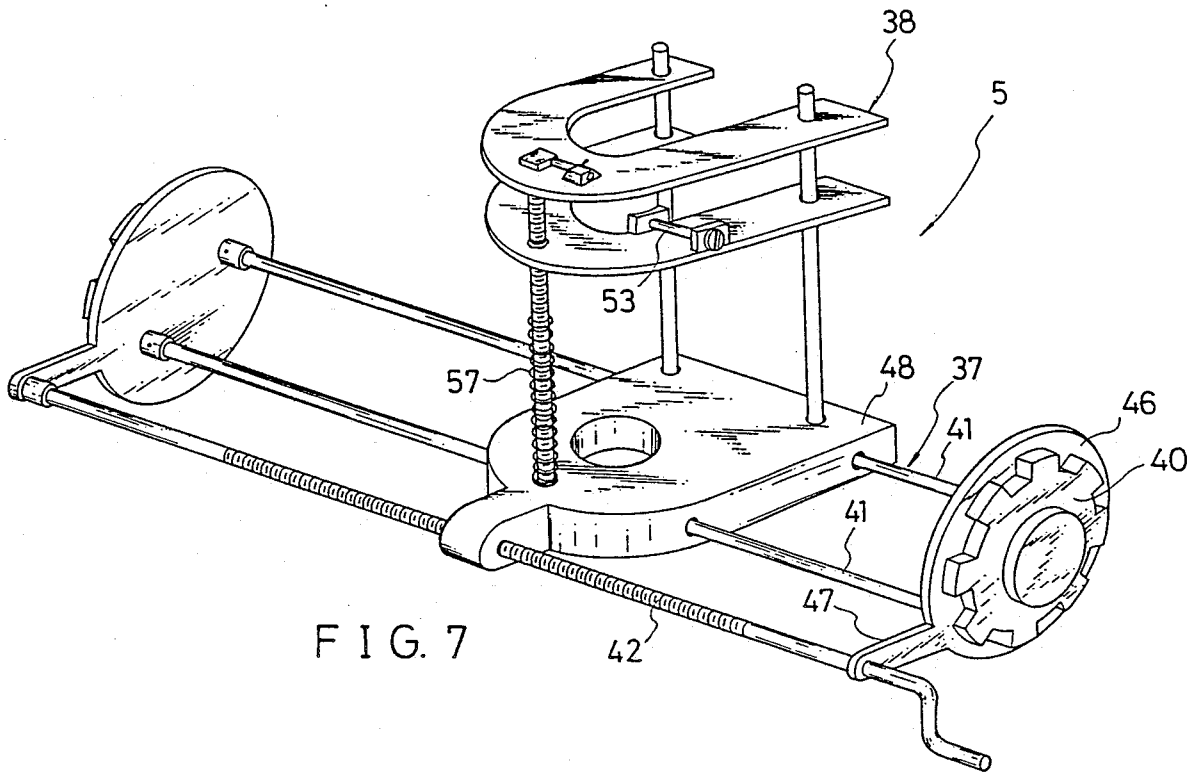
FIG. 7 is a view, showing the whole structure illustrated in FIG. 6.

The L-set block 29 fixed corresponding to the chucking block 27 under the back of the passage 9, has a female screw placed in the middle of its upright portion adapted to receive the threaded rod 30. The forehead of the threaded rod 30 is connected with the sliding block 28, and it being operable by the handle 31 is guided for adjusting the relative position of sliding block 28, which can associate with the chucking block 27 to chuck any two of the o-rings 6 of the work table 1 in position. In FIGS. 1, 4 and 5, there is shown the construction of the quick-going adjusting clamp of no difference from that of the slow-going adjusting clamp except the former has a quick-going adjusting means 32 instead of the slow-going adjusting means 16; therefore, the description of the corresponding parts is omitted. The quick-going adjusting means 32 is formed with a pair of sloping blocks 33 and 34, which are connected by a connecting rod 35, wherein the sloping block 33 is contained within the throughgoing passage 15, and can not pivot but can only change position along throughgoing passage 15. As for the sloping block 34, it is contained within the U-shaped recess 20 under the clamping plate 14, and it can pivot and change position when a handle 36 is being acted upon. When the sloping block 34 has its oblique-angle portion set corresponding to that of the sloping block 33 (as shown in FIG. 5), the U-shaped recess will therefore be sticken firmly above the throughgoing passage 15; if in contrast the oblique angle portions are set opposite to one another, the U-shaped recess is able to be loosened a bit from the throughgoing passage 15, and to make a quick position change to proceed a new orientation as a result of a force acting on it (as shown in FIG. 5B).

As shown in FIG. 3, the slow-going adjusting clamp 3 may have the clamping plate 14 and the U-shaped recess 20 removed and, instead, an L-set plate 39 may be fixed on clamp 3 by a screw 21. Thus, by two each-fronted slow-going clamps 3 and two L-set plates, a fixture 5 may be positioned in between such that a portable tool (like portable drilling machine), can be used. The fixture 5 comprises: a basic seat 37 and a tool-clamping seat 38; wherein the basic seat is composed of two L-set plates 39, two adjusting plates in geared shape 40, two supporting rods 41 and an adjusting threaded rod 42. The L-set plate 39 has a central hole 43 bored therein on its horizontal portion to be provided with a screw by which it is to be connected with the sliding block 22 of the slow-going adjusting clamps. The L-set plate is movable as the sliding block 22 changes position. On the vertical portion of the L-set plate, there is an inverted U-shaped hole 44, having toothed convexities on its inner rim, which are provided to fit in the adjusting plate 40 such that the position and angle of tool-clamping seat 38 can be adjusted. Behind the adjusting plate 40 is a shield 46 on which there is a convex ear 47 provided to receive the adjusting threaded rod 42. The back of the shield 46 is connected with two supporting rods 41 parallel and spaced apart with respect to each other and arranged to pass through the basic plate 48 of tool-clamping seat 38. The tool-clamping seat 38 comprises: a basic plate 48, an upper plate 49, fixing rods 51, a seat plate 50, and a threaded rod 52. The upper plate 49 and the seat plate 50 both are U-shaped. On the seat plate 50 are a set of tool chucks 53 used to chuck tools firmly. Fixing rods 51 pass through the two holes formed on the two arms of the plate 50. On the upper middle of the plate 50 there is a threaded hole 54 which the pivotable threaded rod 52, pass through while the lower portion of the threaded rod 52 is sleeved into a spring 57. The plate 50 will be able to position upwards or downward along the pivotable threaded rod 52 as result of a forces acting on it. The upper plate 49 has its two front corners fixed by the fixing rods 51, and on its upper middle, there is a hole provided for the insertion of threaded rod 52 to be continuously connected with a square cap 55. Besides, there is a bolt set adjacent to the square cap 55 on the upper plate 49 which functions to bolting the square cap 55, so that the threaded rod 52 will not be permitted to pivot and the stability of the tool-clamping seat 38 is therefore ensured. On the top edge of the basic plate 48, there is a convex portion 56, which has a hole adapted to receive the adjusting threaded rod 42. By turning the threaded rod 42, the tool-clamping seat 38 will be able to be positioned the right or left.

Figure 8:
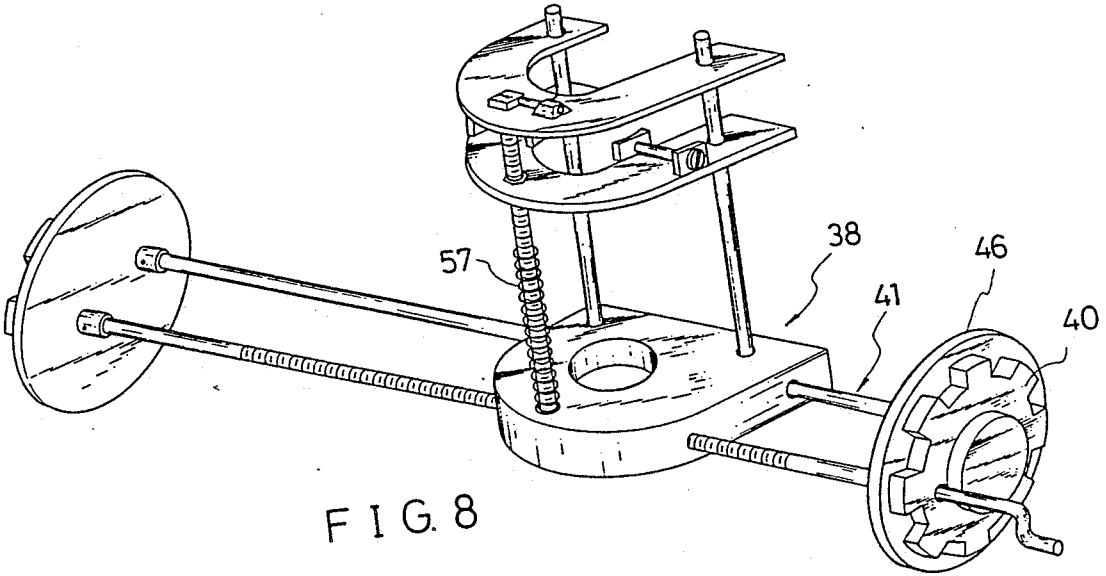
FIG. 8 is a view, showing another embodiment of the structure of FIG. 7.

As illustrated in FIG. 8, the threaded rod 42 can be used instead of one of the supporting rods 41, and the function of adjusting the position of the fixture 5 to the left or right can also be achieved.

Figure 9:
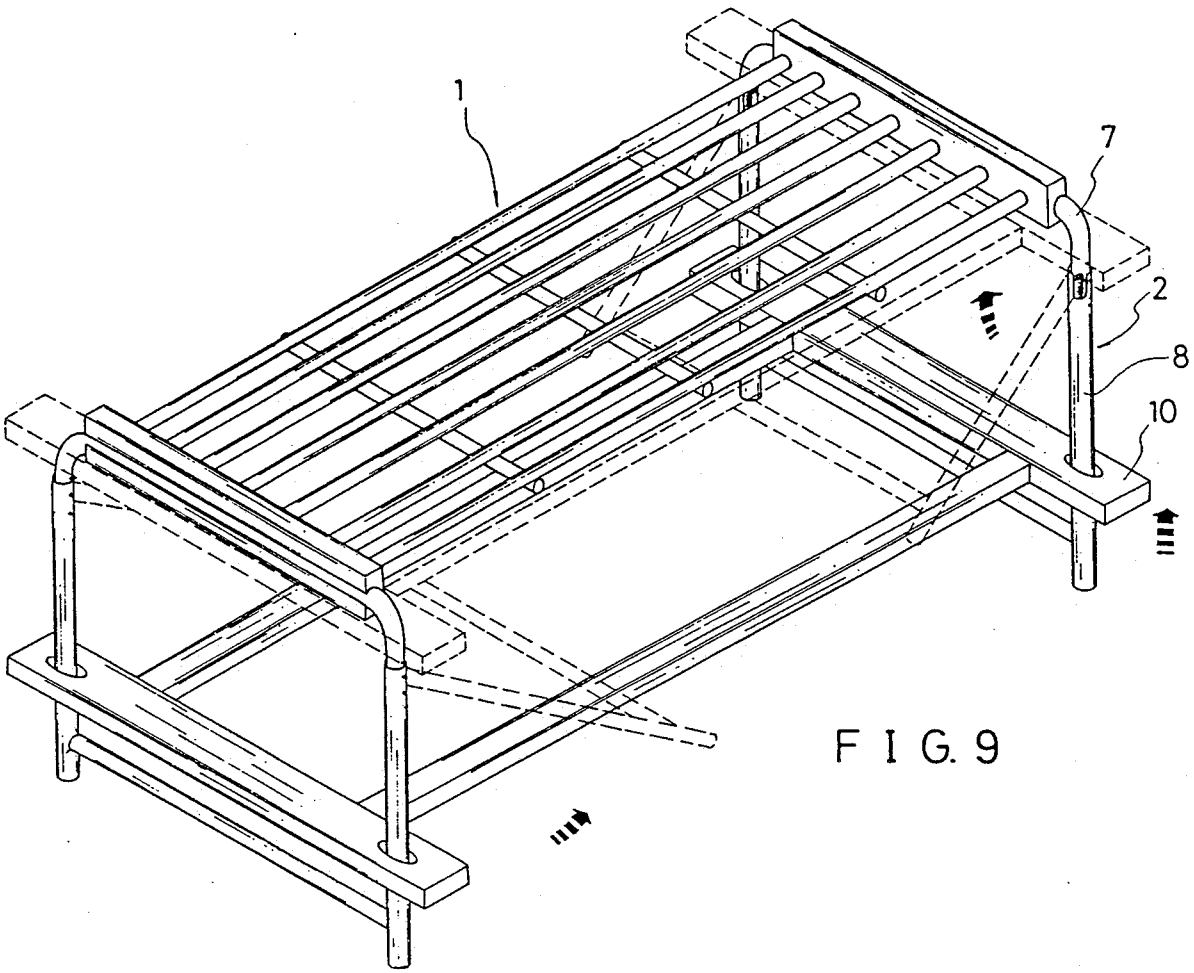
FIG. 9 is a schematic view of another alternative embodiment of the work table, according to the present invention.

In FIG. 9, there is shown an alternative type of this present invention with its work table formed with a plurality of straight rods each horizontally spaced apart to one another. This embodiment may function as same as the type that shown in FIG. 1.

I claim:

1. A workbench comprising:

at least one pair of legs, constituting a foldable stand to support the workbench horizontally;

at least one slow-going adjusting clamp adapted to be fixed in varying positions on the workbench to clamp work pieces thereto;

at least one quick-going adjusting clamp adapted to be fixed in varying positions on the workbench to be associated with the at least one slow-going adjusting clamp to clamp workpieces;

at least two bars, each having at least one o-ring shape of the same shape forming a working surface of the workbench, said bars being horizontally spaced apart from one another; and means for fixing the at least one slow-going adjusting clamp and the at least one quick-going adjusting clamp in position between any two of the bars to treat and clamp workpieces of any shape and size.

2. A workbench as recited in claim 1, wherein said at least one slow-going adjusting clamp comprises a sliding block and wherein a pair of said at least one slow-going adjusting clamps are connected to form a fixture, said fixture comprising:

a basic seat and a tool-clamping seat, said basic seat comprising:

two L-set plates each comprising a horizontal portion, a vertical portion integral with the horizontal portion, a central hole bored therein on the horizontal portion for receiving a screw to connected the L-set plate to the sliding block of the slow-going adjusting clamp, and an inverted U-shaped hole on the vertical portion having toothed convex portions on an inner rim thereof;

two adjusting plates in geared shape received in respective ones of the L-set plates by the toothed convex portions of the inverted U-shaped hole for adjusting the position and angle of the tool-clamping seat;

supporting rods for connecting the two L-set plates to one another;

two shields connected to respective adjusting plates and to the supporting rods, each shield comprising a convex ear; and a first adjusting threaded rod having two ends received in the convex ear on the shields for adjusting the position of the tool-clamping seat.

3. A workbench as claimed in claim 2, wherein the tool-clamping seat comprises:

a second adjusting threaded rod;

a basic plate comprising a plurality of holes formed therein, one of the holes forming a screw hole for receiving the second adjusting threaded rod on the top edge of the basic plate;

a U-shaped upper plate comprising a plurality of holes passing therethrough, one of said holes adapted to receive the second adjusting threaded rod and the upper plate further comprising a square cap on an upper surface of said upper plate to receive said second adjusting threaded rod;

a U-shaped seat plate comprising a plurality of holes passing therethrough and a set of tool chucks for chucking tools firmly; and fixing rods for connecting the basic, upper and seat plates which are inserted in holes formed in the basic plate and pass through holes formed in the upper and seat plates.

* * * * *